United States Patent [19]

Hesse

[11] Patent Number: 4,775,006

[45] Date of Patent: Oct. 4, 1988

[54] HEAT EXCHANGER, PARTICULARLY A COOLANT EVAPORATOR

[75] Inventor: Wolfgang Hesse, Löffingen, Fed. Rep. of Germany

[73] Assignee: Suddeutsche Kulerfabrik, Julius Fr. Behr GmbH & Co. KG, Stuttgart, Fed. Rep. of Germany

[21] Appl. No.: 63,997

[22] Filed: Jun. 19, 1987

[30] Foreign Application Priority Data

Jul. 9, 1986 [DE] Fed. Rep. of Germany ..... 3622952

[51] Int. Cl.[4] ..... F28D 1/04; F28F 1/02

[52] U.S. Cl. ..... 165/150; 165/152; 165/174; 165/176; 62/525

[58] Field of Search ..... 165/153, 176, 144, 150, 165/152, 174; 62/524, 525

[56] References Cited

U.S. PATENT DOCUMENTS

| | | | |
|---|---|---|---|
| 2,063,988 | 12/1936 | Dick | 165/150 |
| 2,136,641 | 11/1938 | Smith | 165/150 |
| 2,322,145 | 6/1943 | Kritzer | 165/150 X |
| 3,042,380 | 7/1962 | Karmazin | 165/150 X |
| 3,976,128 | 8/1976 | Patel | 165/153 |
| 4,215,676 | 8/1980 | Gilliam | 165/150 X |
| 4,274,482 | 6/1981 | Sonoda | 165/153 |
| 4,386,652 | 6/1983 | Dragojeviz | 165/176 X |

FOREIGN PATENT DOCUMENTS

| | | | |
|---|---|---|---|
| 1679429 | 3/1972 | Fed. Rep. of Germany . | |
| 2245091 | 4/1974 | Fed. Rep. of Germany | 165/153 |
| 3028304 | 2/1981 | Fed. Rep. of Germany | 165/153 |
| 3020557 | 12/1981 | Fed. Rep. of Germany . | |
| 3536325 | 5/1986 | Fed. Rep. of Germany . | |
| 2576678 | 1/1986 | France . | |

*Primary Examiner*—Ira S. Lazarus
*Assistant Examiner*—Peggy Neils
*Attorney, Agent, or Firm*—Barnes & Thornburg

[57] ABSTRACT

A heat exchanger, particularly a coolant evaporator, is provided that has several flat pipes that are arranged parallel to one another and are each expanded at their ends with respect to a central part and are closed off by caps. The expanded ends are provided with connecting openings so that the heat exchange medium can flow to the adjacent pipe. At least one of the caps that are provided for closing off the pipe ends is equipped with a projection extending towards the inside of the pipe and closes off at least one of the connecting openings, so that the production of a heat exchanger of identically constructed flat pipes is simplified, in that by the insertion of correponding caps that either expose the connecting openings to the adjacent pipes or not, it is easy to control the flow of the heat exchange medium inside the flat pipes.

18 Claims, 3 Drawing Sheets

HEAT EXCHANGER, PARTICULARLY A COOLANT EVAPORATOR

BACKGROUND AND SUMMARY OF THE INVENTION

The present invention relates to a heat exchanger, particularly for a coolant evaporator having several flat pipes that are arranged parallel to one another and which each have ends which are expanded with respect to a central part of the pipes. These ends have connecting openings for connecting one pipe to an adjacent pipe. The ends are closed off by caps.

Heat exchangers of this type that may be used particularly for coolant evaporators were shown. However, in that heat exchanger, different pipes must be provided at the extreme ends of the pipe block that is formed of flat pipes, that in the expanded part have only one opening that borders on the adjacent pipe. The other side that determines the end of the heat exchanger must be closed.

The same also applies when the heat exchanger is to be equipped with different courses of piping, in other words, when the heat exchange medium is to be guided through the flat pipes in a zig-zag course or is to be guided through groups of these flat pipes. It is therefore a disadvantage that at least two types of flat pipes must be manufactured and stored for assembling the heat exchanger, which increases the constructional expenditures for these types of heat exchangers. It is also a disadvantage that for the finished heat exchanger, it is not possible or is very inconvenient to determine where deflecting points of the pipe courses are provided.

Therefrore, an objective of the present invention is to provide a heat exchanger having connected flat pipes with expanded ends in a manner that is simpler and more advantageous with respect to assembly.

This and other objects are achieved in the present invention by providing a heat exchanger having flat pipes with expanded end areas that are closed off by caps, and which are interconnected through two connecting openings, these flat pipes being identical. At least one of the caps has an indentation extending towards the inside of the flat pipe for closing off one of the connecting openings.

By means of the present invention, all flat pipes are constructed identically and are equipped with two mutually opposite openings in the expanded parts. The closing of individual openings then selectively takes place where it is desired, so that only an exchange must take place of the caps that are provided in any event for closing the pipe ends. It is also advantageous that, after the caps have been fitted on, it can be checked from the outside where one of the two openings of the flat pipe is closed, i.e., where a new course of pipes begins, for example.

Other objects, advantages and novel features of the present invention will become apparent from the following detailed description of the invention when considered in conjunction with the accompanying drawings.

DETAILED DESCRIPTION OF THE DRAWINGS

Figure 1:
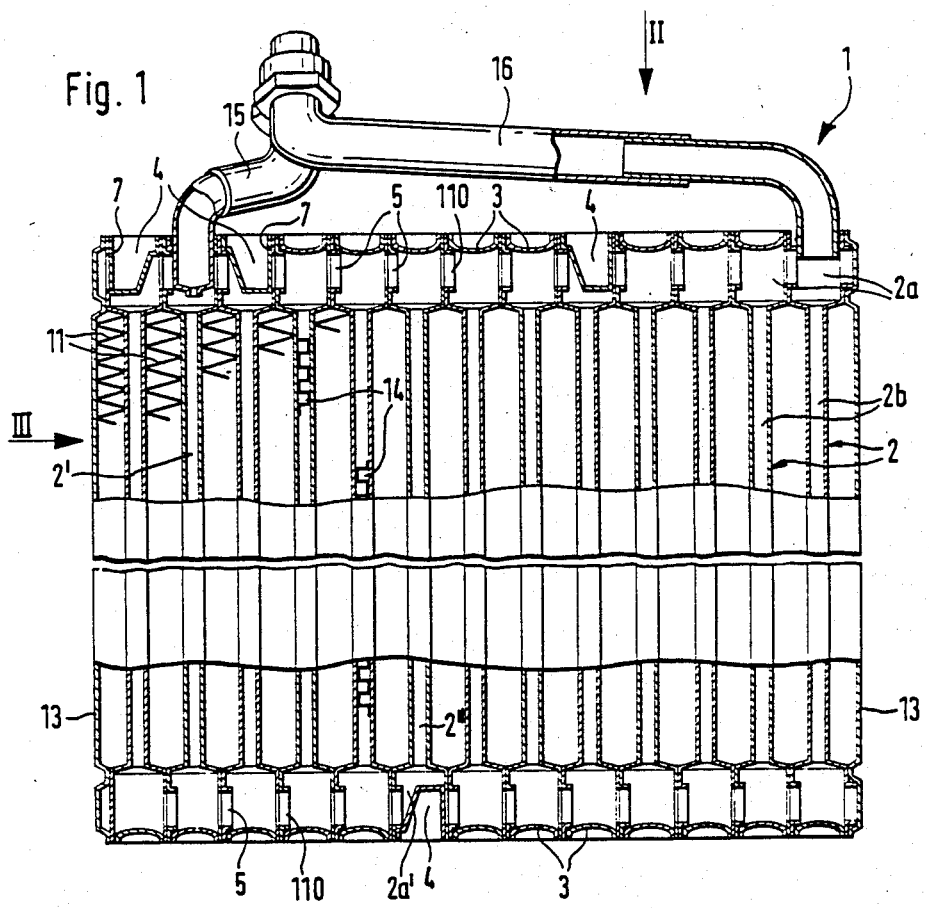
FIG. 1 is a diagrammatic longitudinal sectional view of a heat exchanger constructed in accordance with a preferred embodiment of the present invention as a coolant evaporator.
Figure 2:
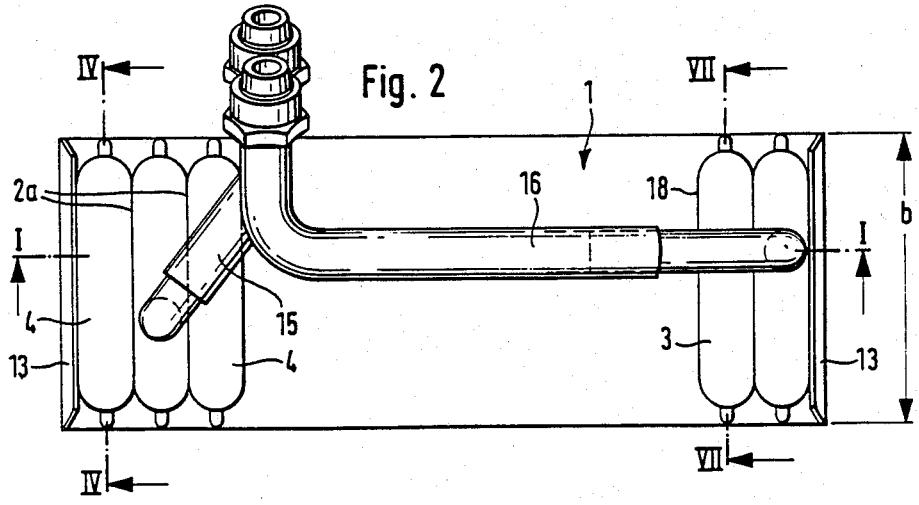
FIG. 2 is a top view of the heat exchanger of FIG. 1 in the direction of Arrow II.
Figure 3:
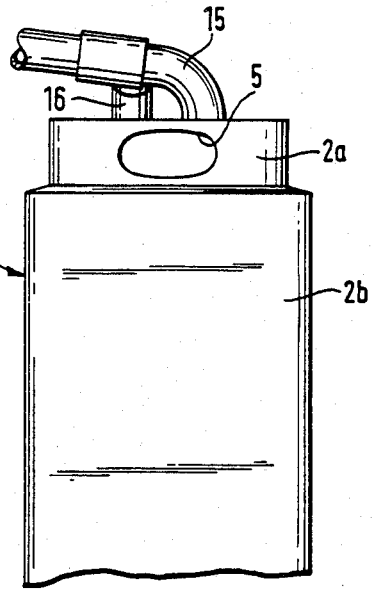
FIG. 3 is a lateral view of the heat exchanger of FIG. 1 in the direction of the Arrow III, but with a lateral part removed.

FIGS. 1 to 3 show a heat exchanger 1 in the form of a coolant evaporator that has several identically constructed flat pipes 2 which ar each equipped with an end area 2*a* that is expanded with respect to the center part 2*b*. These end areas 2*a* have an oval shape and are placed directly against one another. In the illustrated preferred embodiment, the expanded parts 2*a* are each provided with openings 5 on the two wall sides that are opposite and parallel to one another. When the flat pipes 2 are placed against one another; these openings 5 are in alignment with one another because all of the flat pipes are identically formed. This is also due to the fact that in each case (see FIG. 1), the opening of each expanded part 2*a* that points to the right is equipped with a pipe section 110 projecting toward the outside that fits into the opening 5 of the adjacent part 2*a*. By this construction, all the flat pipes 2 can be placed against one another with their expanded parts 2*a* and be mutually fixed in their position before they are soldered together.

In this embodiment, as is also known in other types of constructions, one ribbed insert 11 respectively is inserted between each two adjacent flat pipes 2. This ribbed insert 11 has the purpose of increasing the heat exchange between the flat pipes and the medium flowing through between them. For example, in the illustrated embodiment, air is guided through these spaces and the ribbed inserts 11 (perpendicular to the plane of the paper for FIG. 1) this air being cooled when flowing through the coolant evaporator.

Within the central area 2*b* of each flat pipe, turbulence inserts 14 are provided that are inserted into the pipes in a manner not described here in detail. The heat exchanger 1, toward the outside, is closed off by means of lateral parts 13 that, in a preferred embodiment, are soldered together with the flat pipes, and are fastened at the flat-pipe block in other ways in alternate preferred embodiments.

The feeding and discharge of the coolant and of the heat exchange medium takes place through the feeding pipe 15 and through the discharge pipe 16.

All the flat pipes 2, at both their ends, are tightly sealed off by caps 3 and 4 and thus form a flat-pipe block into which the heat exchange medium is introduced via the feeding pipe 15. In order to achieve that the heat exchange medium flows through the flat-pipe block as uniformly as possible, first, adjacent to the flat pipe 2' to which the heat exchange medium is fed at the top, the adjacent pipes 2 are closed at their tops by means of caps 4. As will be explained in the following by means of FIGS. 4 to 6, these caps 4 are saucer-shaped but have indentations 6. The caps 4 have wall parts 7 that are shaped such that when the cap 4 is inserted, they close off one of the two openings 5 in the expanded parts 2*a* of the flat pipes.

FIG. 1 shows that the outermost of the two caps 4, with its closing wall 7, rests against the exterior side of the outermost flat pipe 2, so that as a result, the flat-pipe block is closed off toward the outside. In the flat pipe that borders the pipe 2′ on the right in FIG. 1, the cap 4 is inserted the other way around so that its closing wall part 7 closes off the opening 5 that points to the right. As a result, the heat exchange medium that is fed through the feeding pipe 15 is forced to flow downward in the first set of three adjacent flat pipes, from which it can then flow into the second set of three adjacent pipes to the pipe 2″. The lower expanded part 2*a*′ of the pipe 2″ is closed off by a cap 4 such that the heat exchange medium cannot flow to the outside nor to the pipe that is adjacent to it on the right. In its upper area, the fifth flat pipe from the right in FIG. 1 is again equipped with a cap 4 so that a zig-zag flow of the heat exchange medium is caused in the flat pipe block, before it is discharged through the discharge pipe section 16.

Figure 7:
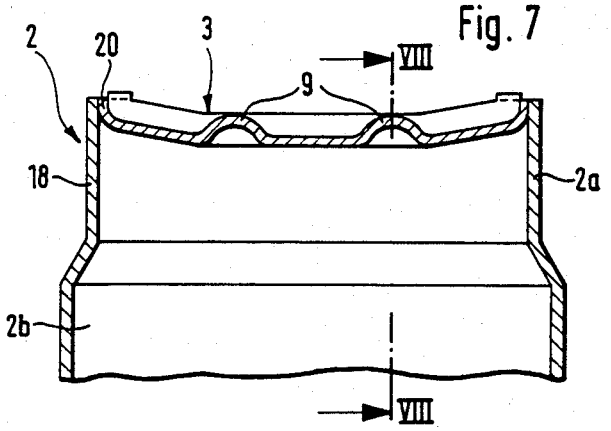
FIG. 7 is an enlarged sectional view of an upper portion of FIG. 2 that is along Line VII—VII.
Figure 8:
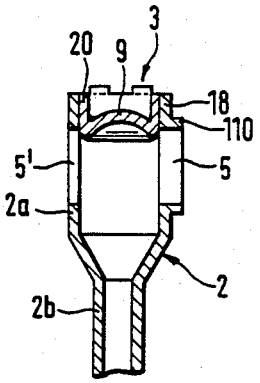
FIG. 8 is a sectional view of FIG. 7 along Line VIII—VIII.
Figure 9:
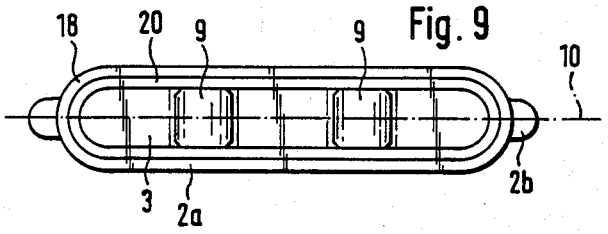
FIG. 9 is a top view of the uppe end of the pipe of FIG. 7.

The expanded parts 2*a* that are not closed off by the caps 4 are tightly closed off by caps 3, the shape of which is best shown in FIGS. 7 to 9. Because of the design of the present invention, it is sufficient to store flat pipes of identical shape which then, as required, are assemblable to form heat exchangers of a certain desirable length and are selectively closed off by caps in such a manner that a desired flow-through is achieved.

After the insertion of the caps and of closing caps that are not described in detail which are provided for inlet and outlet pipe sections, the flat-pipe block is soldered together so that the caps 3, 4 are held tightly in the ends 2*a* of the flat pipes 2. These flat pipes 2 are also held tightly against one another by means of the engaging of the pipe sections 110 and the openings 5. The flat pipes 2 that are provided in the illustrated embodiment have expanded parts 2*a* that do not correspond to the whole width b of the heat exchanger, as seen in FIG. 2. In this embodiment, the flat pipes 2 are produced by starting from pipes 2 with an oval cross-section corresponding to the expanded parts 2*a*, and then rolling flat or pressing flat the central area 2*b* of the pipes 2.

Figure 4:
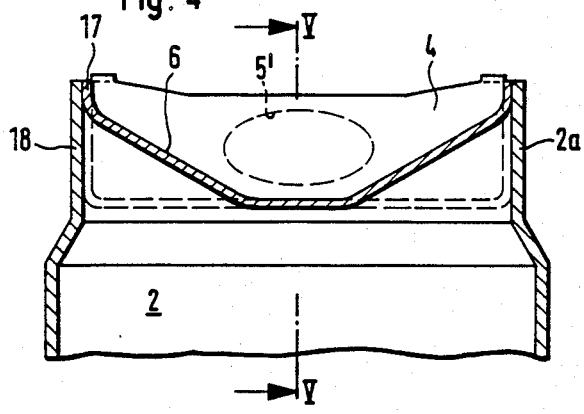
FIG. 4 is an enlarged diagrammatic sectional view of an upper portion of FIG. 2 along Line IV—IV.
Figure 5:
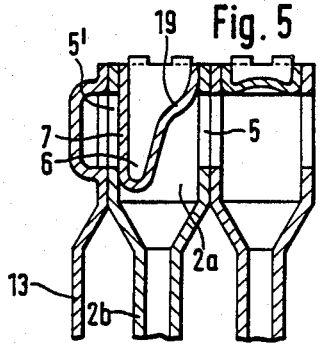
FIG. 5 is a diagrammatic sectional view of FIG. 4 along Line V—V.
Figure 6:
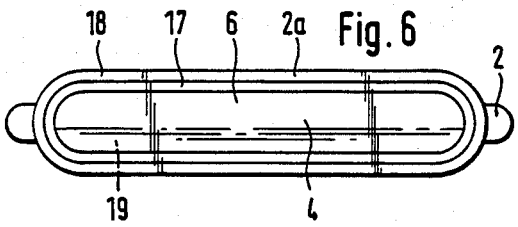
FIG. 6 is a top view of the upper pipe end of FIG. 4.

FIGS. 4 to 6 best show the cap 4 that is inserted in the heat exchanger of FIGS. 1 to 3. The cap 4 has a saucer shape and with its edges 17 sits tightly in the upward-projecting edge 18 of the expanded parts 2*a* of the assigned flat pipes 2. In the illustrated preferred embodiment, the cap 4 has an indentation 6 that has a wall part 7 that, as shown in FIG. 5, closes off the left opening 5′ of the two openings 5′, 5 in the expanded part 2*a* of the flat pipe 2. The indentation 6 is closed off by a diagonally extending wall 19 that is located on the opposite side of the wall part 7, this extending wall 19 extending in such a manner that it is also used as a flow guiding surface for the heat exchange medium flowing between the opening 5 and the area 2*b*.

FIGS. 7 to 9 show that each cap 3 also consists of a saucer-shaped part, the edges 20 of which point to the outside and are adapted to the internal cross-section of the expanded part 2*a* of each flat pipe 2. These saucer-shaped caps 3 have reinforcing beads 9 that extend transversely to the longitudinal axis 10 of the oval shape and have the purpose of increasing the stability of the caps 3. These caps 3 are used exclusively for the external closure of each flat pipe 2. Just like the caps 4, they are soldered tightly into the flat pipes 2.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A heat exchanger having several flat pipes that are arranged parallel to one another and which each have ends which are expanded with respect to a central part of said pipes, said expanded ends having connecting openings for connecting one said pipe to an expanding end of an adjacent said pipe, and cap means for closing off said ends of said pipes facing away from the central parts thereof; wherein: all said flat pipes are identical and have two respective connecting openings to said adjacent flat pipes at a respective end thereof, and at least one said cap means has an indentation extending toward the inside of said flat pipe that closes off at least one of said connecting openings.

2. A heat exchanger according to claim 1, wherein said indentations are wall parts projecting to the inside of said flat pipes.

3. A heat exchanger according to claim 2, wherein said wall parts are part of said indentations, and said caps having said indentations are saucer-shaped.

4. A heat exchanger according to claim 1, wherein said ends have an oval cross-section and said caps not equipped with said indentations have reinforcing beads that extent transversely to a longitudinal axis of said caps, said caps having a shape corresponding to said oval cross-section of said ends.

5. A heat exchanger according to claim 1, wherein one of said connecting openings of each said pipe has a pipe section which projects from an edge of said opening toward the outside, an outside diameter of said pipe section corresponding to an inside diameter of a connecting opening of an adjacent said flat pipe.

6. A heat exchanger according to claim 5, wherein said pipe section has a length that is approximately equal to a depth of said connecting opening.

7. A heat exchanger according to claim 1, wherein said heat exchanger is a coolant evaporator.

8. A heat exchanger comprising:

a plurality of flat pipes disposed parallel to one another for accommodating the flow of a first heat exchange medium therethrough, each of said flat pipes having first and second expanded end portions connected by a central portion of smaller cross-sectional area than the end portions such that the central portions of adjacent pipes are spaced from one another to accommodate flow of a second heat exchange medium thereby, each of said end portions including a pair of fluid openings for communicating said end portion with respective end portions of immediately adjacent pipes, and end cap means for each pipe for closing off said end portions at sides thereof facing away from the respective central portion, wherein at least one of said end cap means has an indentation extending toward a respective central portion to close off one of said fluid openings to block flow of said first heat exchange medium to an adjacent pipe end portion.

9. A heat exchanger according to claim 8, wherein at least one of said end cap means is configured to only close off an outer end of a respective pipe end portion without closing off either of its respective pair of fluid openings such that immediately adjacent pipe end portions form a common header for the flow of the first heat exchange medium.

10. A heat exchanged according to claim 9, wherein one of said fluid openings of each flat pipe has a pipe section which projects from an edge of said opening outwardly of the respective pipe section, and wherein one of said fluid openings of each flat pipe has a cross-sectional size which accommodates insertion therein of said pipe section of an adjacent flat pipe.

11. A heat exchanger according to claim 8, wherein one of said fluid openings of each flat pipe has a pipe section which projects from an edge of said opening outwardly of the respective pipe section, and wherein one of said fluid openings of each flat pipe has a cross-sectional size which accommodates insertion therein of said pipe section of an adjacent flat pipe.

12. A heat exchanger according to claim 8, wherein feeding pipe means open into a first of said flat pipes for feeding said first fluid medium to an end portion of said first flat pipe, wherein second and third flat pipes adjacent said first flat pipe are provided with said cap means having an indentation such that first, second and third flat pipes have end portions communicating with one another while being separated from other adjacent flat pipes so that said first fluid medium flows in the same direction through said first, second and third flat pipes.

13. A heat exchanger according to claim 12, wherein the end portion of said third flat pipe opposite the feeding pipe means is communicated with a plurality of adjacent flat pipes by respective ones of said fluid openings to form a common header for return flow of said first fluid medium toward the feeding pipe means end.

14. A heat exchanger according to claim 8, wherein a plurality of respective end portions at each end of the flat pipes are covered by respective said end cap means having said indentation such that flow of said first fluid medium is reversed to flow through respective pluralities of adjacent flat pipes in a zigzag pattern from a feeding pipe inlet opening into an end portion of one of said flat pipes to a discharge pipe opening to an end portion of another of said flat pipes.

15. A heat exchanger according to claim 8, wherein said cap means are soldered to said flat pipe end portions.

16. A heat exchanger according to claim 8, wherein a plurality of identical ones of said end cap means with said indentations are provided, said end cap means with said indentations being symmetrically constructed to accommodate blockage of fluid openings facing in opposite directions by respective inversion of said end cap means.

17. A heat exchanger according to claim 14, wherein a plurality of identical ones of said end cap means with said indentations are provided, said end cap means with said indentations being symmetrically constructed to accommodate blockage of fluid openings facing in oposite directions by respective inversion of said end cap means.

18. A heat exchanger according to claim 17, wherein a plurality of identical ones of said end cap means without said end cap means are provided for closing off respective end portions of said flat pipes which are not closed off by the end cap means with said indentations.

* * * * *